US007644601B2

(12) United States Patent
Brochheuser et al.

(10) Patent No.: US 7,644,601 B2
(45) Date of Patent: Jan. 12, 2010

(54) REDUCING TUBES OVER A STEPPED MANDREL TO MANUFACTURE TUBULAR SHAFTS HAVING AN UNDERCUT IN ONE OPERATION

(75) Inventors: Ulrich Brochheuser, Neunkirchen (DE); Andreas Gehrke, Siegburg (DE)

(73) Assignee: GKN Driveline International, GmbH, Lohmar (DE)

( * ) Notice: Subject to any disclaimer, the term of this patent is extended or adjusted under 35 U.S.C. 154(b) by 286 days.

(21) Appl. No.: 10/562,658

(22) PCT Filed: Feb. 2, 2005

(86) PCT No.: PCT/EP2005/001001

§ 371 (c)(1),
(2), (4) Date: Apr. 19, 2006

(87) PCT Pub. No.: WO2006/053590

PCT Pub. Date: May 26, 2006

(65) Prior Publication Data

US 2008/0115553 A1 May 22, 2008

(30) Foreign Application Priority Data

Nov. 20, 2004 (DE) ..... 10 2004 056 147

(51) Int. Cl.
*B21C 1/24* (2006.01)

(52) U.S. Cl. ..... 72/283; 72/370.01; 72/370.14; 72/370.15

(58) Field of Classification Search ..... 72/260, 72/264, 266, 283, 370.01, 370.06, 370.14, 72/370.15, 370.24, 370.25, 370.02, 370.03, 72/370.1, 370.23
See application file for complete search history.

(56) References Cited

U.S. PATENT DOCUMENTS

| | | | | | |
|---|---|---|---|---|---|
| 4,161,112 | A | * | 7/1979 | Stump | 72/283 |
| 4,277,969 | A | * | 7/1981 | Simon | 72/266 |
| 4,292,831 | A | | 10/1981 | Simon | |
| 4,616,500 | A | * | 10/1986 | Alexoff | 72/283 |
| 4,726,211 | A | | 2/1988 | Sunaga et al. | |
| 5,119,662 | A | * | 6/1992 | Sunaga et al. | 72/283 |

(Continued)

FOREIGN PATENT DOCUMENTS

| | | | |
|---|---|---|---|
| CN | 1195306 | A | 10/1998 |

(Continued)

*Primary Examiner*—Edward Tolan
(74) *Attorney, Agent, or Firm*—Rader, Fishman & Grauer, PLLC

(57) ABSTRACT

A method for manufacturing hollow shafts having end portions of greater wall thickness and at least one intermediate portion of reduced wall thickness, from a tube having constant wall thickness. The method includes providing a mandrel having diameters stepped over its length, with a first longitudinal section having a smallest diameter and at least one further longitudinal section having a further larger diameter. Reducing the external diameter of a first portion of the tube over the first longitudinal section of the mandrel to produce the first end portion. Reducing the external diameter of a middle portion of the tube over the at least one further longitudinal section of the mandrel to produce the at least one intermediate portion. Reducing the external diameter of a further portion of the tube over the first longitudinal section of the mandrel to produce the second end portion.

9 Claims, 3 Drawing Sheets

U.S. PATENT DOCUMENTS

| | | | | |
|---|---|---|---|---|
| 5,522,246 | A * | 6/1996 | Simon | 72/260 |
| 5,606,583 | A * | 2/1997 | Verdier | 376/260 |
| 5,644,938 | A * | 7/1997 | Moeltner et al. | 72/96 |
| 6,038,901 | A * | 3/2000 | Stein et al. | 72/85 |
| 6,134,937 | A | 10/2000 | Lee et al. | |
| 6,718,811 | B2 * | 4/2004 | Drillon et al. | 72/208 |
| 6,758,077 | B2 * | 7/2004 | Kaneko | 72/85 |
| 6,837,091 | B2 | 1/2005 | Brochheuser et al. | |
| 7,114,362 | B2 * | 10/2006 | Mitchell et al. | 72/370.25 |
| 7,412,866 | B2 * | 8/2008 | Jahani et al. | 72/370.01 |

FOREIGN PATENT DOCUMENTS

| | | | |
|---|---|---|---|
| DE | 30 16 135 | A1 | 10/1981 |
| DE | 35 06 220 | A1 | 8/1986 |
| DE | 36 22 678 | A1 | 1/1987 |
| DE | 195 08 798 | A1 | 9/1995 |
| EP | 0 663 248 | A1 | 1/1995 |
| EP | 1 177 843 | A2 | 2/2002 |

* cited by examiner

REDUCING TUBES OVER A STEPPED MANDREL TO MANUFACTURE TUBULAR SHAFTS HAVING AN UNDERCUT IN ONE OPERATION

TECHNICAL FIELD

The present invention relates to a method for manufacturing hollow shafts having end portions of greater wall thickness and at least one intermediate portion of reduced wall thickness, from a tube previously having constant wall thickness, using a mandrel having diameters stepped over the length, which has a first longitudinal section having a smallest diameter and at least one further longitudinal section having a further larger diameter.

BACKGROUND

A method of this type is known from U.S. Pat. No. 6,837,091. In this case, a first end portion of the tube is reduced freely in external diameter in a matrix without internal support, a middle tube portion having lesser wall thickness and larger external diameter is manufactured by stretching over an internal mandrel of constant diameter, and a second end portion of the tube is manufactured through reduction in external diameter in a matrix in the opposite drawing direction or through hammering without internal support.

A method of the type cited, in which a first portion of a tube is reduced over a calibration mandrel which is introduced from the tube end discussed, and in which an intermediate portion of the tube is reduced over a stretching mandrel, which is introduced from the other tube end, is known from DE 35 06 220 A1. The second end portion of the tube is reduced over the calibration mandrel again after changeover of the tube. The stretching mandrel comprises two longitudinal sections of different diameters having a conical transition area.

SUMMARY OF THE INVENTION

The present invention provides a dimensionally accurate method, which may be performed efficiently, for manufacturing hollow shafts of the above-mentioned type.

A method of the type cited is provided, having the following steps: reducing the external diameter of a first portion of the tube over the first longitudinal section of the mandrel to produce the first end portion of the hollow shaft; reducing the external diameter of at least one middle portion of the tube over the at least one further longitudinal section of the mandrel to produce the at least one intermediate portion of the hollow shaft; and reducing the external diameter of a further portion of the tube over another longitudinal section of the mandrel to produce the second end portion of the hollow shaft.

This method has the advantage that all longitudinal portions of the hollow shaft are reduced over a single mandrel, the orientation of the direction of tube and mandrel to one another remaining the same. In this case, the method is applied in such a way that in the event of one or more changes of the relative position of mandrel and tube, the entire process up to manufacturing a finished hollow shaft may occur in a uniform feed direction of mandrel and tube in relation to one another without a tool change. For this purpose, the first end portion and one or more intermediate portions of the hollow shaft, having a reduced wall thickness in each case, may be produced with unchanged axial position of the mandrel in relation to the tube. If the two end portions are to have the same cross-section, the second end portion is particularly also to be produced over the first longitudinal section of the mandrel. Furthermore, one or more further intermediate portions, each having an increased wall thickness respectively, and the second end portion of the hollow shaft may be produced with a changed axial position of the mandrel in relation to the tube in each case, drawn out from the tube step-by-step. Finally, between the above-mentioned shaping steps, at least two intermediate portions having alternating wall thicknesses, first increased in relation to the preceding wall thickness and then reduced again in relation to the last wall thickness, may be produced. The reduction of the external diameter of the tube can be performed through cold drawing using a matrix; alternatively, the reduction of the external diameter of the tube is also possible through swaging, roll bending, or rolling, however.

Furthermore, transitions between end portions and intermediate portions and transitions between intermediate portions of different wall thicknesses be formed by internal conical surfaces having a cone opening angle between 5 and 45°. A further embodiment provides that the wall thickness ratio between end portions and the adjoining intermediate portion of smallest wall thickness is greater than 1.6.

BRIEF DESCRIPTION OF THE DRAWINGS

Preferred exemplary embodiments for performing the method according to the present invention are illustrated in the drawing and will be described in the following.

A) the tube in the starting state;

B) the tube having inserted mandrel and applied matrix;

C) the tube after the reduction of the first tube end to form the first end portion and the stretching of a middle intermediate portion;

D) the tube before the reduction of the second tube end;

E) after the reduction of the second tube end to form the second end portion; and F) the finished hollow shaft.

FIG. 2 shows, in a method for manufacturing a hollow shaft having a multiply stepped intermediate portion:

A) the tube in the starting state;

B) the tube having inserted mandrel and applied matrix;

C) the tube after the reduction of the first tube end to form the first end portion and a first intermediate portion and the stretching of a middle intermediate portion;

D) the tube before the reduction of a second intermediate portion;

E) the tube after the reduction of a second intermediate portion;

F) the tube before the reduction of the second tube end;

G) the tube after the reduction of the second tube end to form the second end portion; and H) the finished hollow shaft.

FIG. 3 shows, in a method for manufacturing a hollow shaft having a multiply stepped intermediate portion in a second embodiment:

A) the tube in the starting state;

B) the tube having inserted mandrel and applied matrix;

C) the tube after the reduction of the first tube end to form the first end portion and a first intermediate portion and the stretching of a first thin-walled intermediate portion;

D) the tube before the reduction of a thick-walled intermediate portion;

E) the tube after the reduction of the thick-walled intermediate portion and the stretching of a second thin-walled intermediate portion;

F) the tube before the reduction of the second tube end;

G) the tube after the reduction of the second tube end to form the second end portion;

H) the finished hollow shaft.

DETAILED DESCRIPTION

Figure 1A:
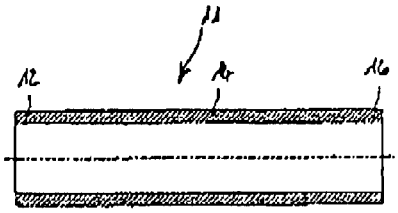
FIG. 1 shows, in a method for manufacturing a hollow shaft having a uniform middle intermediate portion.
Figure 1B:
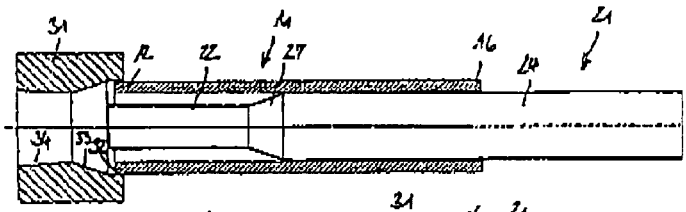

FIG. 1A shows an illustration a of a tube 11 in the starting state, in which a first tube end 12 is identified on the left and a second tube end 16 is identified on the right, while a middle portion is identified by 14.

It may be seen in FIG. 5B that a matrix 31 is applied to the left first tube end 12 and a mandrel 21 is inserted into the interior of the tube, which essentially terminates with the left first tube end 12 and projects out of the right second tube end 16. The mandrel 21 has a first longitudinal section 22 having minimal diameter and a further longitudinal section 24 having a diameter which is essentially seated fixed in the tube 11. A conical transition section 27 is located between the first longitudinal section 22 and the further longitudinal section 24.

Figure 1C:
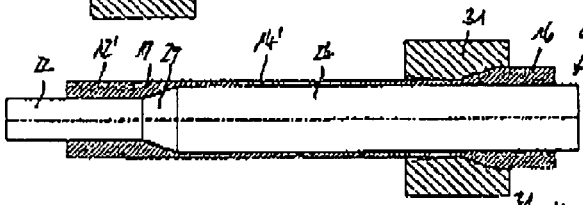

FIG. 1C shows how two phases of the shaft manufacturing have already been finished through a relative movement of matrix 31 (to the right) and mandrel 21 (to the left). Using the matrix 31, the first tube end has been reduced in external diameter while increasing the wall thickness to produce a first shaft end 12' over the longitudinal section 22 of the mandrel 21. Furthermore, the middle portion has been reduced to form an intermediate portion 14' of the hollow shaft 11' over the second longitudinal section 24 of the mandrel 21. An internal conical transition area 17 has been formed over the transition section 27.

Figure 1D:
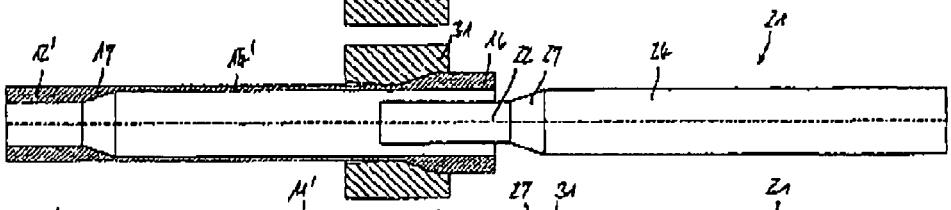

In FIG. 1D, the mandrel 21 has been pulled back into a second axial position in relation to the matrix 31, the first longitudinal section 22 of the mandrel 21 being inserted axially into the second tube end 16.

Figure 1E:
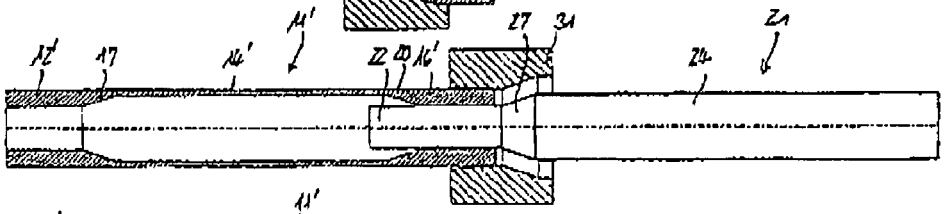

In FIG. 1E, the tube 11 is shown after the completion of a third phase of the shaft manufacturing, the second tube end having been reduced in external diameter to manufacture a second shaft end 16' with wall thickness increased, the tube being supported radially on the inside on the longitudinal section 22 of the mandrel 21. An internal conical transition area 20 between the intermediate portion 14' and the second end portion 16' of the hollow shaft 11' is formed for this purpose solely by reducing the external diameter without internal support.

Figure 1F:
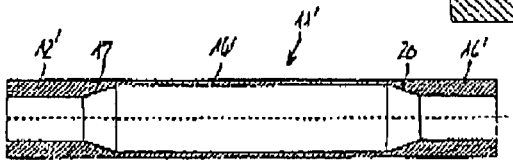

In FIG. 1F, the finished hollow shaft 11' having the two strengthened shaft ends 12', 16' and the intermediate portion 14' of reduced wall thickness is shown, two internal conical transition areas 17, 20 being recognizable.

Figure 2A:
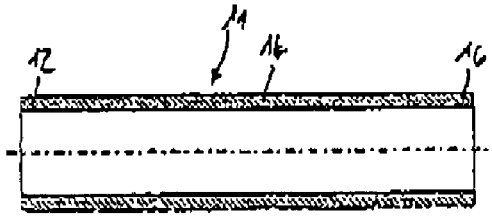

In FIG. 2A, a tube 11 of constant wall thickness is shown in the starting state.

Figure 2B:
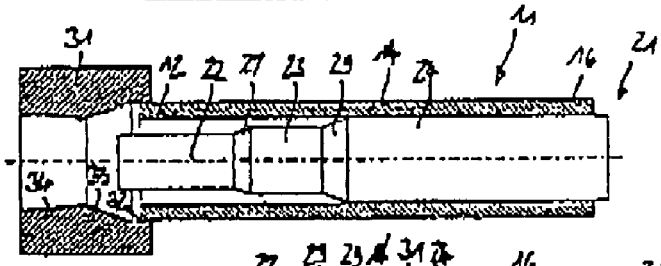

In FIG. 2B, a matrix 31 is applied to the tube 11, while a mandrel 21 is inserted into the interior of the tube, which comprises a first, a second, and a further longitudinal section 22, 23, 24 and conical transition sections 27, 29 lying between them, which increase in diameter from the free end on the left to the end on the right. The matrix 31 is applied to the left tube end 12. The right tube end 16 may be axially supported.

Figure 2C:
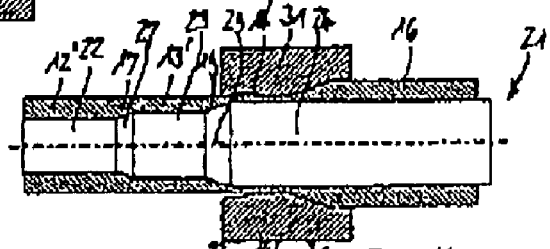

In FIG. 2C, a partially finished hollow shaft 11' is shown after performing three manufacturing phases. By reducing the external diameter while increasing the wall thickness, a first shaft end 12' has been produced, which is supported radially on the inside on the first longitudinal section 22 of the mandrel 21. A first intermediate portion 13 has also resulted with reduction of the external diameter and simultaneous stretching, which is supported on the longitudinal section 23 of the mandrel 21, and a second intermediate portion 14, which is supported on the longitudinal section 24 of the mandrel 21, has resulted with reduction of the external diameter.

Figure 2D:
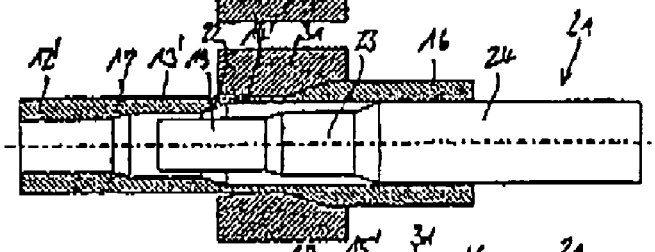

In FIG. 2D, the mandrel 21 is pulled back into an axial position in relation to the matrix 31 in which the longitudinal section 23 of the mandrel 21 is inserted into the second tube end 16 of the tube 11, which has not yet been shaped. The tube 11 is held axially in the matrix 31.

Figure 2E:
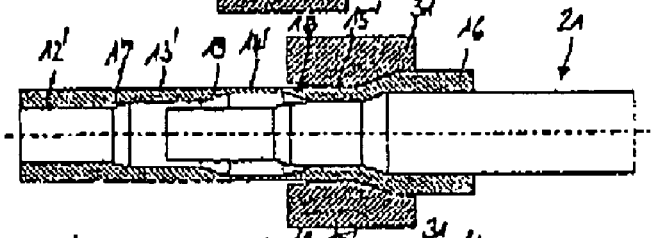

FIG. 2E shows how a further intermediate portion 15 has resulted through reduction of the external diameter with partial stretching, whose wall thickness and length corresponds to the first intermediate portion 13 of the hollow shaft 11' and which is supported radially on the longitudinal section 23 of the mandrel 21.

Figure 2F:
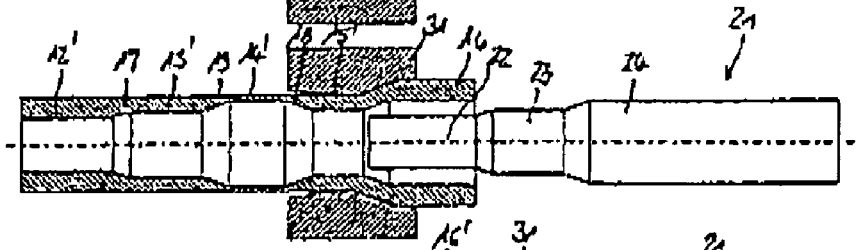

FIG. 2F shows how the mandrel 21 is again pulled to the right out of the matrix 31, in which the hollow shaft 11 is held axially, the first longitudinal section 22 of the mandrel 21 now being inserted into the last unshaped portion of the right tube end 16.

Figure 2G:
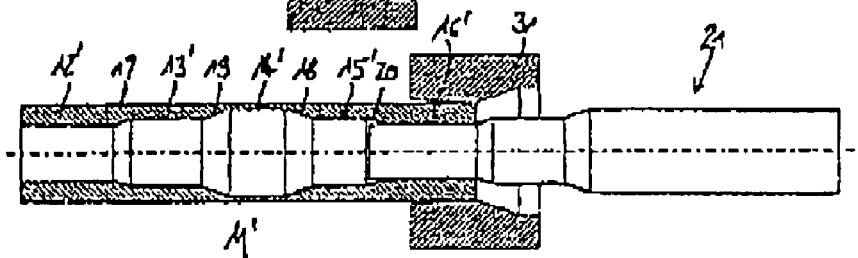

In FIG. 2G, it may be seen how a second shaft end 16' has been manufactured by reducing the external diameter using the matrix 31, which is supported internally on the longitudinal section 22 of the mandrel 21 with wall thickness reduction and whose length and dimensions correspond to the first shaft end 12' in the present case.

Figure 2H:
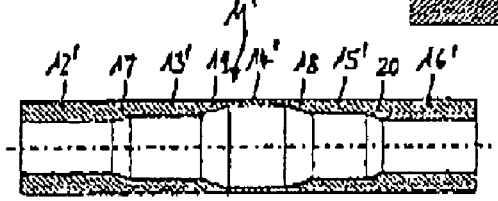

The finished hollow shaft 11' is shown in FIG. 2H, in which the two shaft ends 12', 16' and the intermediate portions 13', 14', 15' may be seen. The transitions are each formed by internal conical transition areas 17, 18, 19, 20. The external diameter of the entire hollow shaft 11 is constant over the length, corresponding to the active diameter of the matrix 31.

For both embodiments, it is to be noted here that in the practical application, the matrix 31 can be held axially fixed, while the entire relative motion is performed by the mandrel 21 having the tube 11 seated. Specifically, a cylindrical intake area 32, an internal conical reduction and stretching area 33, and an outlet cone 34 may be differentiated on the matrix. Instead of the cold drawing shown here using the matrix, milling or swaging or rolling of the external surface of the tube may also be applied, the particular tool being axially displaced in the corresponding phases in relation to the mandrel in the direction corresponding with the matrix in each case.

Figure 3A:
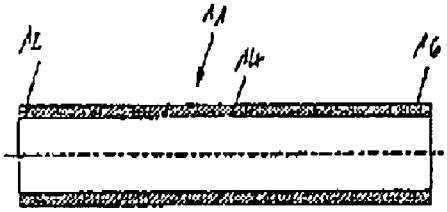

In FIG. 3A, a tube 11 of constant wall thickness is shown in the starting state.

Figure 3B:
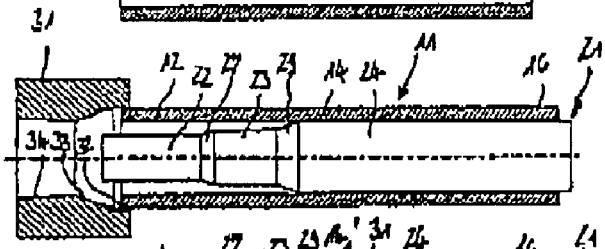

In FIG. 3B, a matrix 31 has been applied to the tube 11, while a mandrel 21 has been inserted into the interior of the tube, which comprises a first, a second, and a further longitudinal portion 22, 23, 24 and conical transition areas 27, 29 lying between each of them, which increase in diameter from the free end on the left to the end on the right. The matrix 31 is applied to the left tube end 12. The right tube end 16 may be axially supported.

Figure 3C:
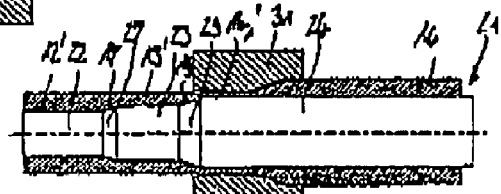

A partially finished hollow shaft 11' is shown in FIG. 3C after three manufacturing phases have been performed. A first shaft end 12' has been produced by reducing the external diameter while increasing the wall thickness, which is supported radially on the inside on the first longitudinal section 22 of the mandrel 21. A first intermediate portion 13 has resulted, also with reduction of the external diameter and simultaneous stretching, which is supported on the longitudinal section 23 of the mandrel 21, and a first thin-walled intermediate portion $14_1$, which is supported on the longitudinal section 24 of the mandrel 21, has resulted with reduction of the external diameter.

Figure 3D:
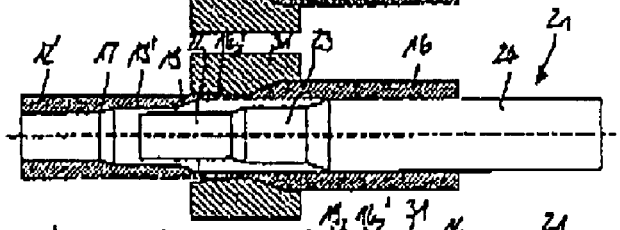

In FIG. 3D, the mandrel 21 is pulled back in relation to the matrix 31 into an axial position in which the longitudinal section 23 of the mandrel 21 is inserted into the second, still unshaped tube end 16 of the tube 11. The tube 11 is held axially in the matrix 31.

Figure 3E:
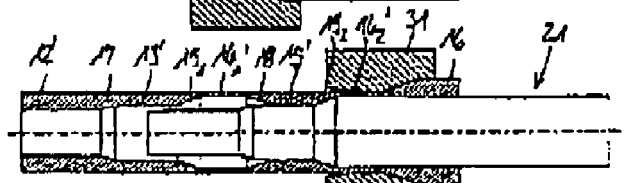

FIG. 3E shows how a thick-walled intermediate portion 15, which is supported radially on the longitudinal section 23 of the mandrel 21, has resulted through reduction of the external diameter with partial stretching. Furthermore, a second thin-walled intermediate portion $14_2$, which is supported radially on the longitudinal section 24 of the mandrel 21, has resulted through stretching of an adjoining longitudinal portion over the longitudinal section 24 of the mandrel 21.

Figure 3F:
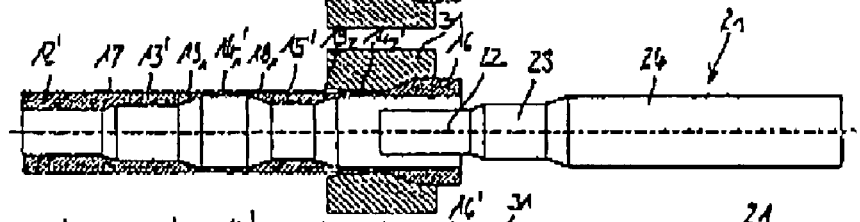

FIG. 3F shows how the mandrel 21 has again been pulled out to the right from the matrix 31, in which the hollow shaft 11 is held axially, the first longitudinal section 22 of the mandrel 21 now being inserted in the last unshaped portion of the right tube end 16.

Figure 3G:
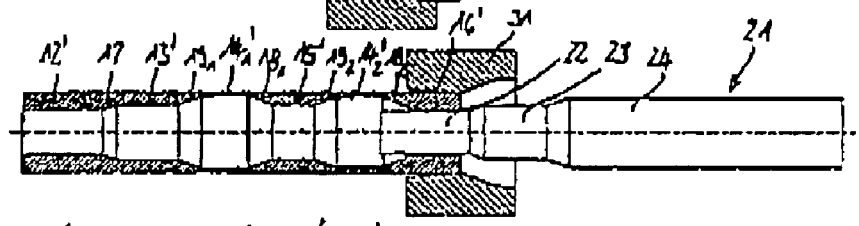

In FIG. 3G, it may be seen how a second shaft end 16', which is supported on the inside on the longitudinal section 22 of the mandrel 21 with wall thickness reduction and which corresponds in length and dimensions to the first shaft end 12' in the present case, has been manufactured by reducing the external diameter using the matrix 31.

Figure 3H:
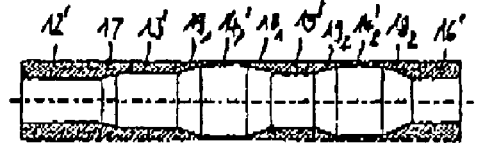

The finished hollow shaft 11' is shown in FIG. 3H, in which the two shaft ends 12', 16' and intermediate portions 13', 14', 15', $14_2$' may be seen. The transitions are each formed by internal conical transition areas 17, $18_1$, $19_1$, $18_2$, $19_2$. The external diameter of the overall hollow shaft 11 is constant over the length, corresponding to the active diameter of the matrix 31.

For these embodiments, it is to be noted here that in the practical application, the matrix 31 can be held axially fixed, while the entire relative motion is performed by the mandrel 21 having the tube 11 seated. Specifically, a cylindrical intake area 32, an internal conical reduction and stretching area 33, and an outlet cone 34 may be differentiated on the matrix. Instead of the cold drawing shown here using the matrix, milling or swaging or rolling of the external surface of the tube may also be applied, the particular tool being axially displaced in the corresponding phases in relation to the mandrel in the direction corresponding with the matrix in each case.

The invention claimed is:

1. A method for manufacturing hollow shafts having first and second end portions of greater wall thickness and at least two intermediate portions of reduced wall thickness, from a tube having constant wall thickness, comprising:

providing a mandrel having diameters stepped over its length, including at least a first longitudinal section having a smallest first diameter and, adjacent to said first longitudinal section, a second longitudinal section having a second diameter being greater than said first diameter of said first longitudinal section, and, adjacent to said second longitudinal section, a third longitudinal section having a third diameter being greater than said second diameter of said second longitudinal section, the mandrel comprising a first transition portion between said first longitudinal section and said second longitudinal section, the mandrel further comprising a second transition portion between said second longitudinal section and said third longitudinal section;

inserting the mandrel into the tube;

reducing the external diameter of a first portion of the tube over the first longitudinal section of the mandrel to produce the first end portion;

reducing the external diameter of at least one first middle portion of the tube over said second longitudinal section of said mandrel to produce a first intermediate portion of said at least two intermediate portions of said hollow shaft, said first intermediate portion of said hollow shaft being arranged adjacent to said first end portion;

reducing the external diameter of at least one second middle portion of the tube over said third longitudinal section of said mandrel to produce a second intermediate portion of said at least two intermediate portions of said hollow shaft, said second intermediate portion of said hollow shaft being arranged adjacent to said first intermediate portion of said hollow shaft; and reducing the external diameter of a further portion of the tube over the first, the second or another longitudinal section of the mandrel to produce the second end portion;

wherein a wall thickness ratio between the first end portion of the hollow shaft and an intermediate portion having a smallest wall thickness is greater than 1.6.

2. The method according to claim 1, wherein the first end portion and one or more intermediate portions of the hollow shaft, having a reduced wall thickness in each case, are produced with an unchanged axial position of the mandrel in relation to the tube.

3. The method according to claim 1, wherein the second end portion of the hollow shaft is produced over the first longitudinal section of the mandrel.

4. The method according to claim 3, wherein one or more further intermediate portions, each having an increased wall thickness, and the second end portion are each produced with a changed axial position of the mandrel in relation to the tube.

5. The method according to claim 3, wherein at least two intermediate portions, alternately having first increased, then reduced wall thickness, are produced with an unchanged axial position of the mandrel in relation to the tube in each case.

6. The method according to claim 1, wherein the steps of reducing comprise cold drawing using a matrix, through which the tube is guided from one tube end, and wherein the tube and mandrel are on one side and the matrix is on the other side moving axially in relation thereto.

7. The method according to one claim 1, wherein the external diameter of the tube is reduced through swaging, roll bending, or rolling.

8. The method according to claim 1, wherein transition areas between end portions and intermediate portions, and transition areas between intermediate portions of different wall thicknesses are formed by internal conical surfaces having a cone opening angle between 5° and 45°.

9. The method according to claim 1, wherein a wall thickness ratio between the end portions and the intermediate portion of smallest wall thickness is greater than 1.6.

* * * * *